US005195254A

United States Patent [19]

Tyng

[11] Patent Number: 5,195,254

[45] Date of Patent: Mar. 23, 1993

[54] SOLE

[76] Inventor: Liou Y. Tyng, P.O. Box 82-144, Taipei, Taiwan

[21] Appl. No.: 719,749

[22] Filed: Jun. 24, 1991

[51] Int. Cl.[5] ..... A43B 7/06; A43B 13/20

[52] U.S. Cl. ..... 36/3 R; 36/3 B; 36/29

[58] Field of Search ..... 36/3 R, 3 B, 28, 29, 36/35 B, 71

[56] References Cited

U.S. PATENT DOCUMENTS

| | | | |
|---|---|---|---|
| 311,046 | 1/1885 | Trask | 36/3 B |
| 363,377 | 5/1887 | Faye, Jr. | 36/3 R |
| 426,495 | 4/1890 | Falkner | 36/3 R |
| 1,517,170 | 11/1924 | Rosenthal | 36/3 B |
| 1,974,456 | 9/1934 | Goldzweig | 36/3 R |
| 2,266,476 | 12/1941 | Riess | 36/3 R |
| 2,344,762 | 3/1944 | Wylie | 36/3 B |
| 3,225,463 | 12/1965 | Burnham | 36/3 R |
| 3,973,336 | 8/1976 | Ahn | 36/3 B |
| 4,071,963 | 2/1978 | Fukuoka | 36/3 B |
| 4,290,211 | 9/1981 | Csengeri | 36/3 B |
| 4,417,407 | 11/1983 | Fukuoka | 36/3 B |

FOREIGN PATENT DOCUMENTS

| | | | |
|---|---|---|---|
| 692635 | 8/1964 | Canada | 36/3 R |

*Primary Examiner*—Steven N. Meyers
*Assistant Examiner*—M. D. Patterson
*Attorney, Agent, or Firm*—Alfred Lei

[57] ABSTRACT

This invention relates to a sole for a shoe and in particular to one including a resilient pad provided with a plurality of arrow-shaped recesses and diamond-shaped recesses on the bottom and an elongated slot on the top, a blast device adapted to be received in the elongated slot of the resilient pad and having a first air bag at one end, a second air bag at the other, and an air pipe connecting the first air bag and the second air bag, and a piece of cloth covering the top of the resilient pad, whereby air convection may take place in the shoe thus providing fresh air to the foot wearing the shoe.

1 Claim, 9 Drawing Sheets

A–A

B–B

C–C

SOLE

BACKGROUND OF THE INVENTION

It is found that the prior art sole is a solid member and so air convection cannot take place since there can be no massive transfer of material. Hence, soles made of porous material have been developed to meet this need. However, such soles cannot provide sufficient air convection and are still unsatisfactory in use.

Therefore, it is an object of the present invention to provide an improved sole which may obviate and mitigate the above-mentioned drawbacks.

SUMMARY OF THE INVENTION

This invention relates to an improved sole for shoes.

It is the primary object of the present invention to provide a sole which may provide a good ventilation for the foot.

It is another object of the present invention to provide a sole which may prevent the shoe from slipping.

It is still another object of the present invention to provide a sole which is easy to fabricate.

It is still another object of the present invention to provide a sole which is fit for mass production.

It is still another object of the present invention to provide a sole which is practical in use.

It is a further object of the present invention to provide a sole which is economic to produce.

Other objects and merits and a fuller understanding of the present invention will be obtained by those having ordinary skill in the art when the following detailed description is read in conjunction with the accompanying drawings.

DETAILED DESCRIPTION OF THE PREFERRED EMBODIMENT

Figure 1:
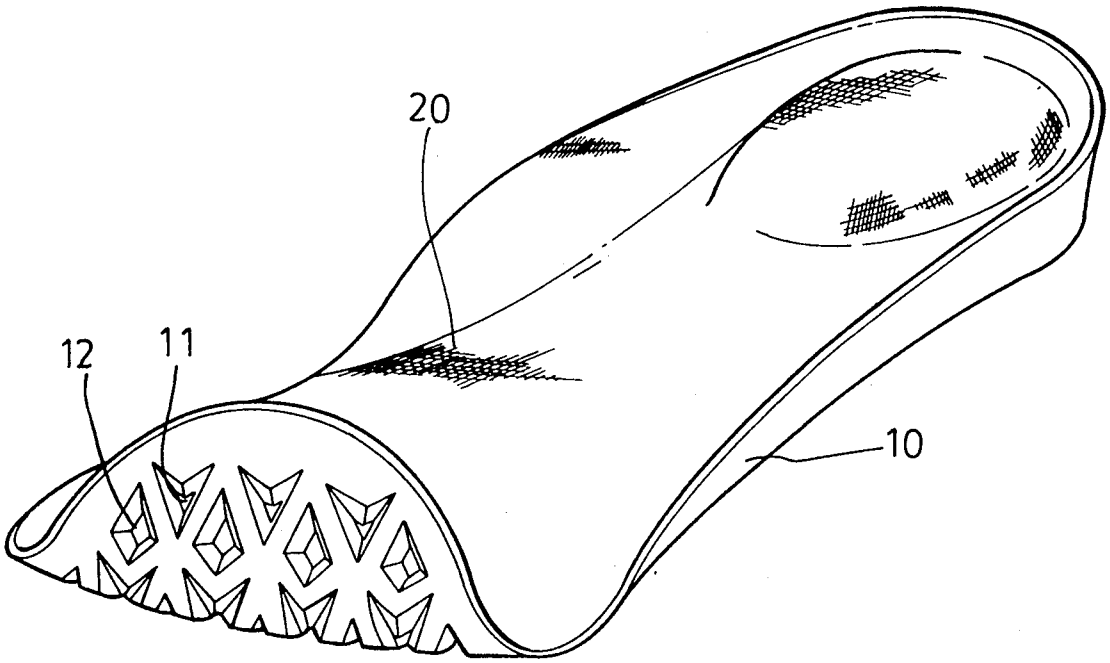
FIG. 1 is a perspective view of a sole with its head portion turned upwards according to the present invention.
Figure 2:
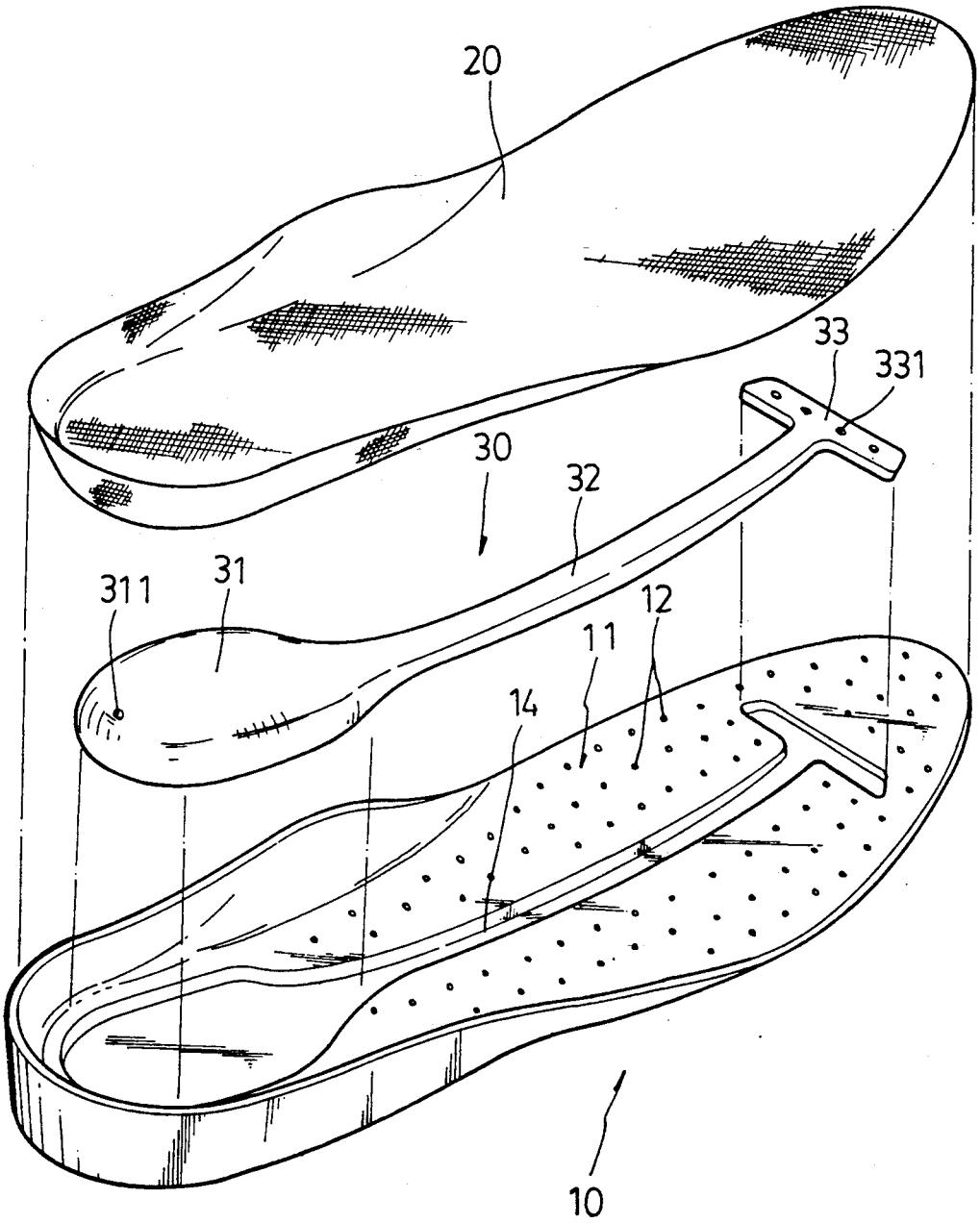
FIG. 2 is an exploded view of the sole.

With reference to the drawings and in particular to FIGS. 1 and 2 thereof, the sole according to the present invention mainly comprises a resilient pad 10 made of an appropriate material, a piece of cloth 20 covering the resilient pad 10, and a blast device 30 disposed between the resilient pad 10 and the cloth 20.

Figure 3:
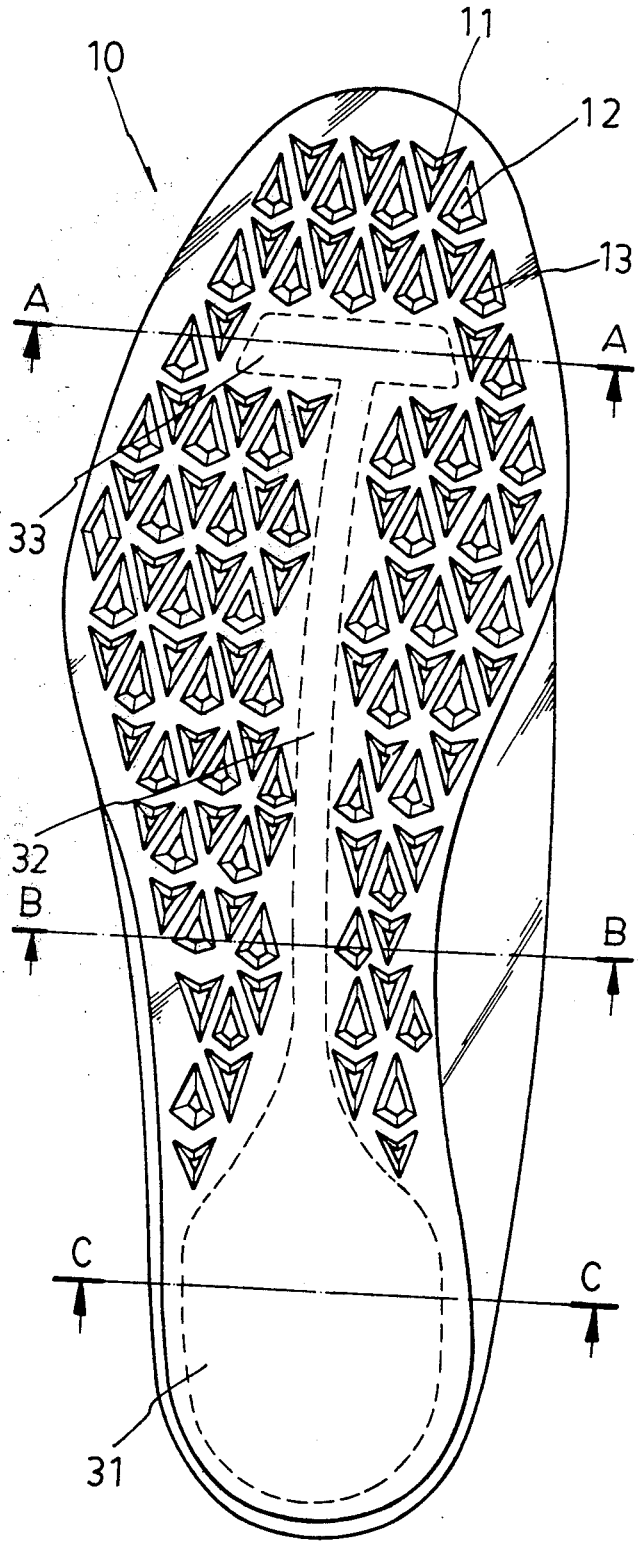
FIG. 3 is bottom view of the sole.

The resilient pad 10 is provided with a plurality of arrow-shaped recesses 11 and diamond-shaped recesses 12 all over its bottom except the portion for mounting the blast device 30. As shown in FIG. 3, both the arrow-shaped recess 11 and the diamond-shaped recess 12 extend obliquely and upwardly to form a smaller open top thereby providing a chamber 13. When the arrow-shaped recess 11 and the diamond-shaped recess 12 are squeezed, the chamber 13 will be decreased in volume thereby ejecting air through the chamber 13 and the cloth 20 and therefore providing fresh air to the foot. As the arrow-shaped recess 11 and the diamond-shaped recess 12 are no longer subjected to squeeze, the chamber 13 will recover to its original volume.

In addition to the above-mentioned air ejecting function, the alternate arrangement of the arrow-shaped recess 11 and the diamond-shaped recess 12 may effectively absorb the pressure thereby preventing the pad from slipping and keeping the pad in position.

Figure 4:
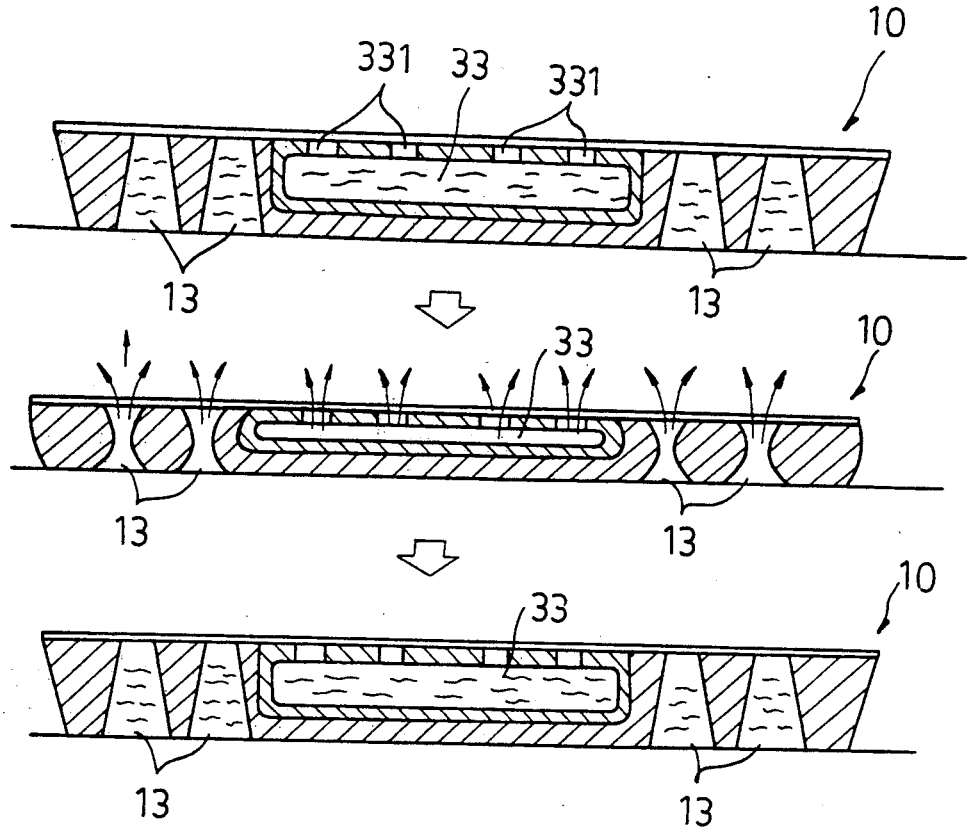
FIG. 4 shows the way how air is ejected upwards when the chamber is squeezed.
Figure 5:
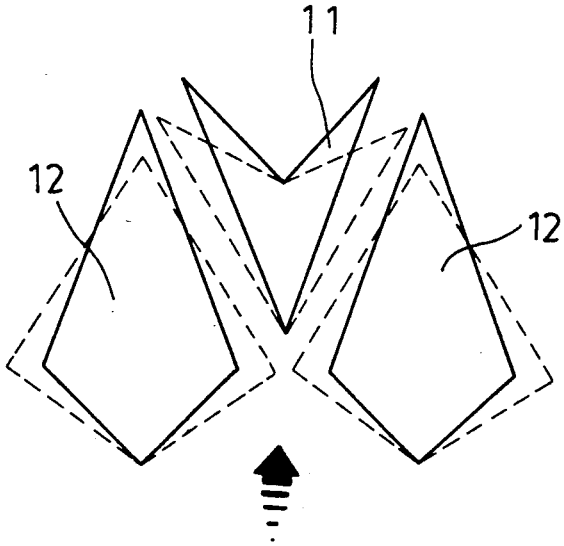
FIG. 5 shows the deformation of the arrow-shaped recess and the diamond-shaped recess.
Figure 6:
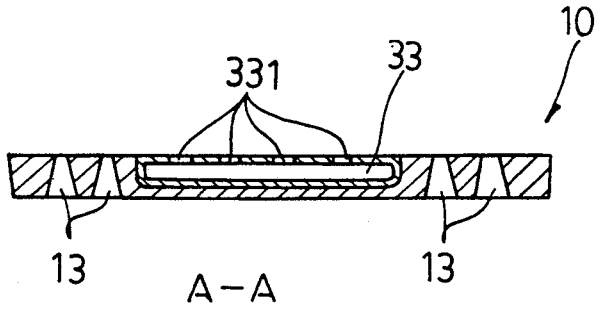
FIG. 6 is a sectional view taken along line A—A of FIG. 3.
Figure 7:
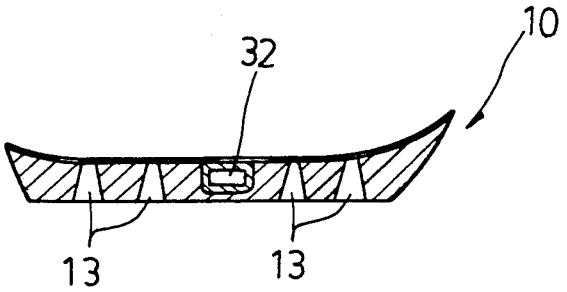
FIG. 7 is a sectional view taken along line B—B of FIG. 3.
Figure 8:
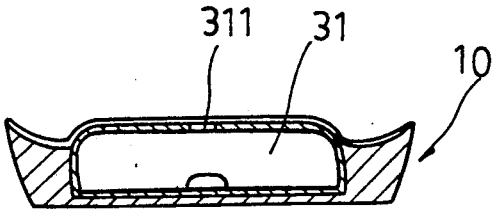
FIG. 8 is a sectional view taken along line C—C of FIG. 3.
Figure 9:
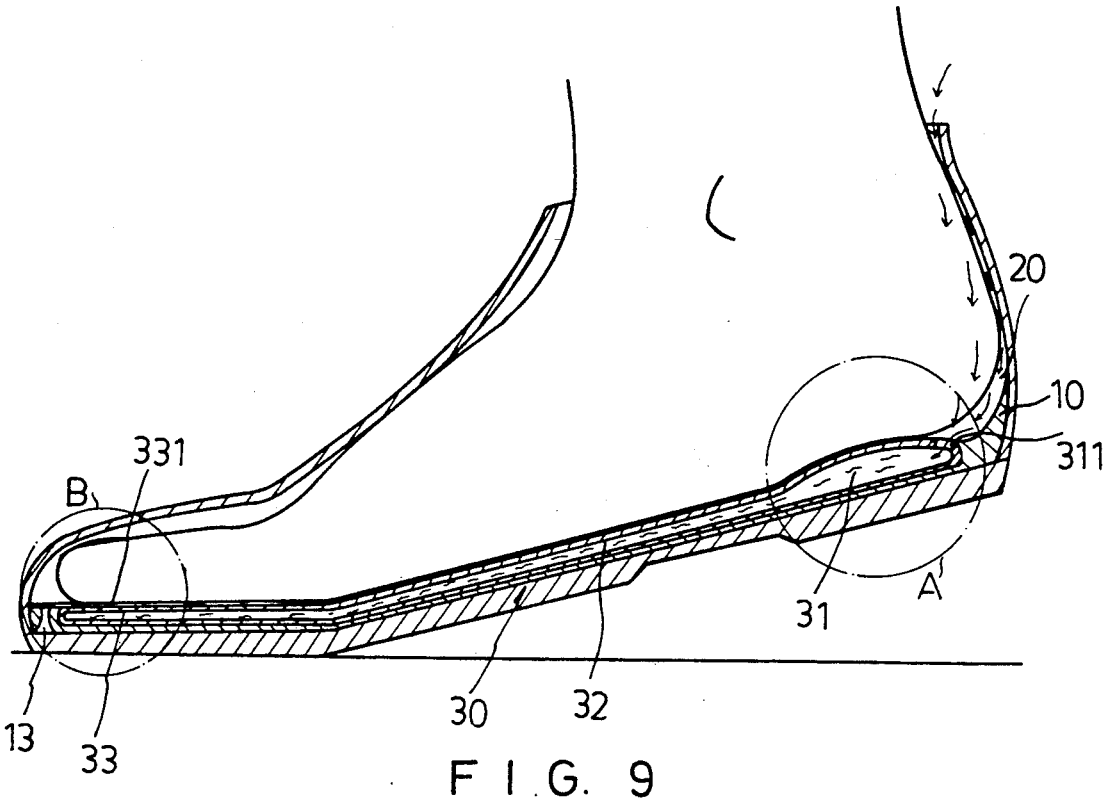
FIG. 9 is a working view of the present invention with the heel lifted upwards.
Figure 9B:
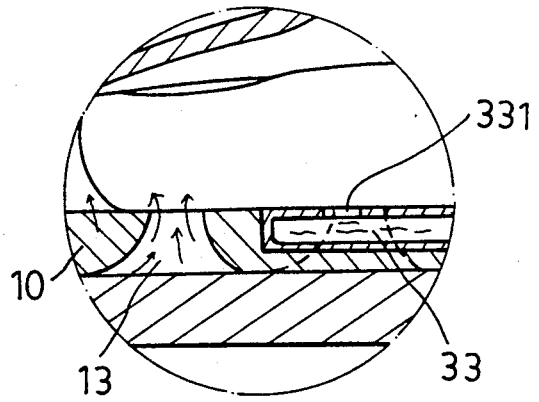
FIG. 9B is an enlarged view of portion B shown in FIG. 9.
Figure 9A:
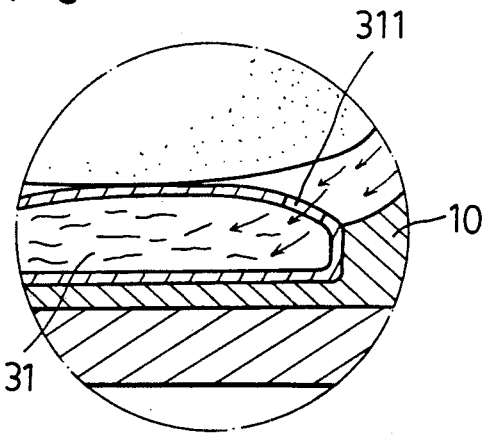
FIG. 9A is an enlarged view of portion A shown in FIG. 9.
Figures 10, 10A, 10B:
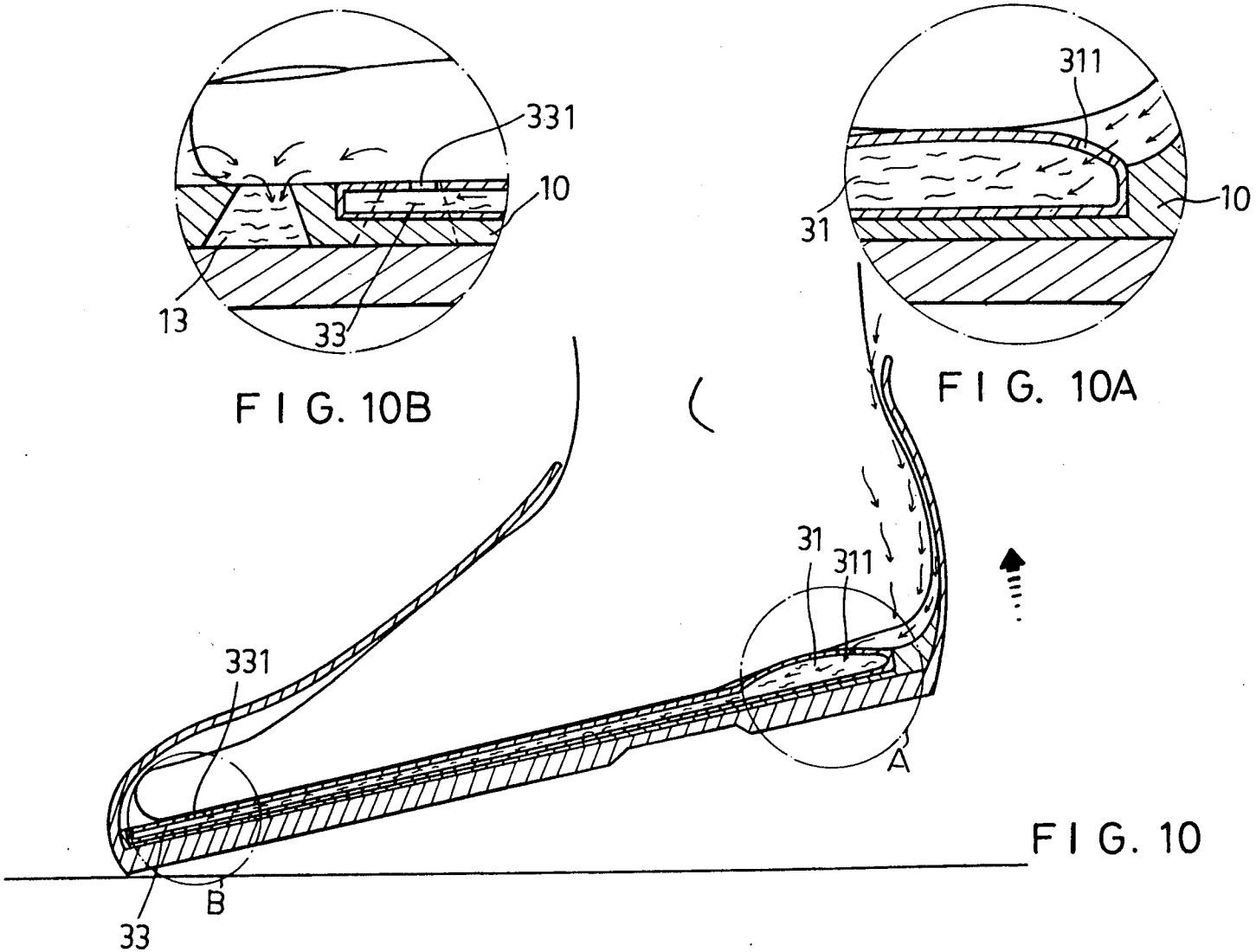
FIG. 10 is a working view of the present invention with the sole lifted off the ground.
FIG. 10A is an enlarged view of portion A shown in FIG. 10.
FIG. 10B is an enlarged view of portion B shown in FIG. 10.
Figure 11:
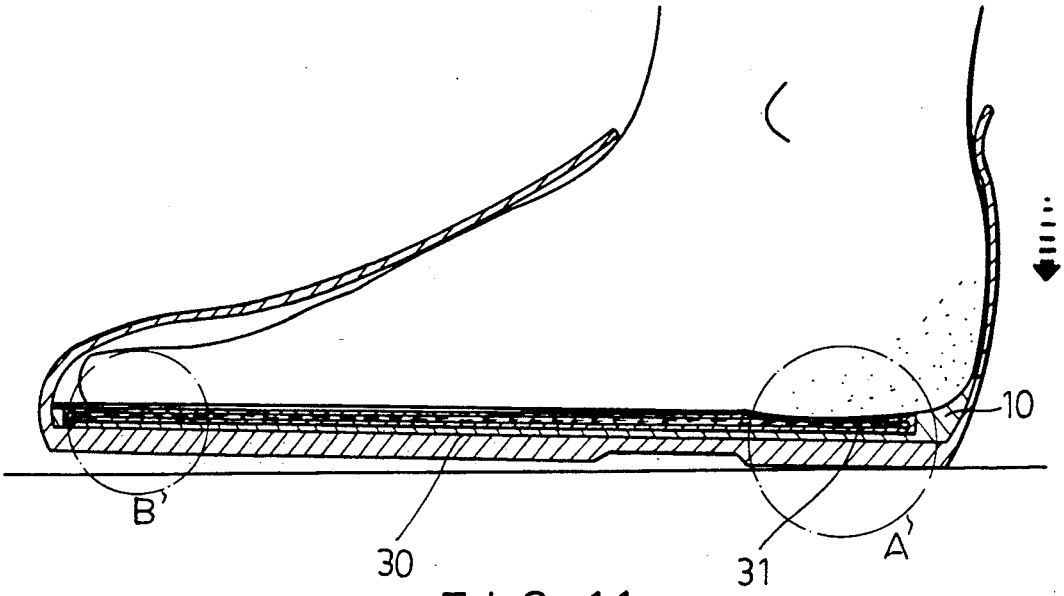
FIG. 11 is a working view of the present invention with the heel contacting the ground.
Figure 11B:
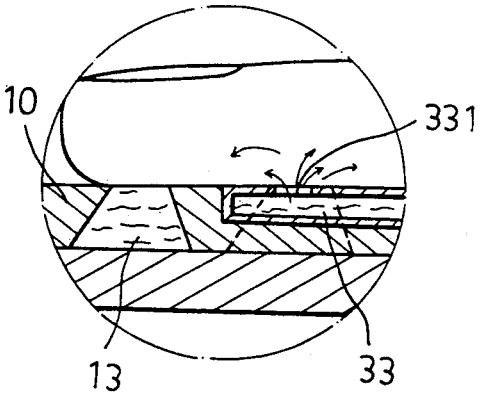
FIG. 11B is an enlarged view of portion B shown in FIG. 11.
Figure 11A:
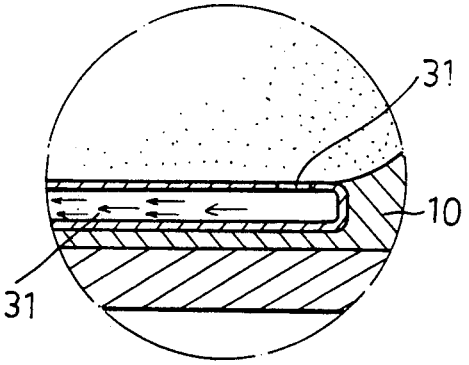
FIG. 11A is an enlarged view of portion A shown in FIG. 11.
Figure 12A:
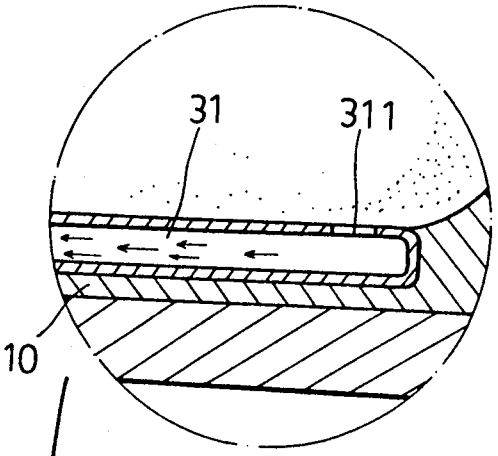
FIG. 12A is an enlarged view of portion A shown in FIG. 12.
Figure 12B:
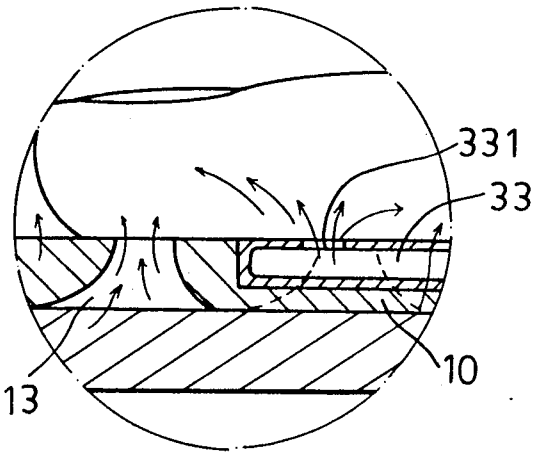
FIG. 12B is an enlarged view of portion B shown in FIG. 12.
Figure 12:
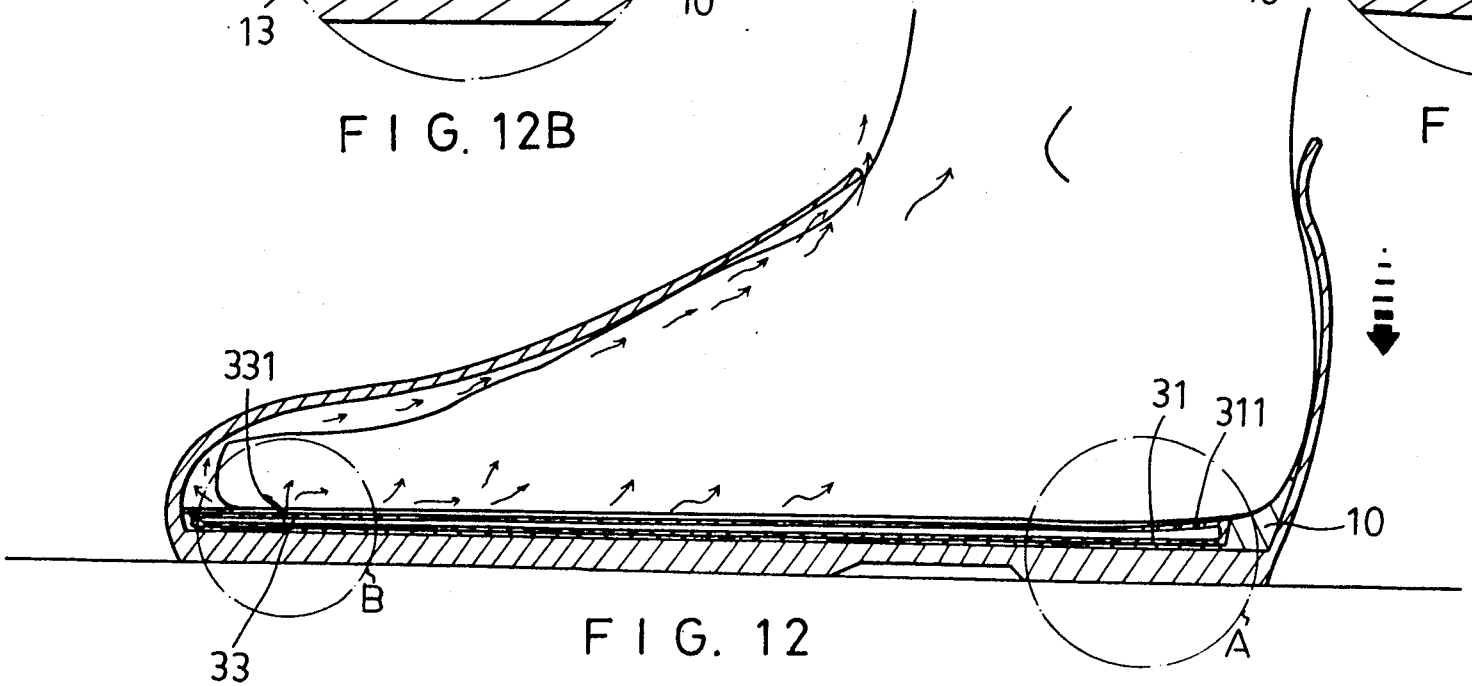
FIG. 12 is a working view of the present invention with the sole contacting the ground.

The top of the resilient pad 10 is formed with an elongated slot 14 for receiving the blast device 30 which is covered with the cloth 20. As the blast device 30 is pressed, the arrow-shaped recess 11 and the diamond-shaped recess 12 will be deformed as shown in FIG. 4. The blast device 30 is provided with a first air bag 31 at one end, a second air bag 33 at the other, and an air pipe 32 connecting the first air bag 31 with the second air bag 33. The first air bag 31 has an outlet 311 while the second air bag 33 is formed with a number of outlets 331. As illustrated in FIGS. 3, 6, 7 and 8, there is shown the structure of the air bags 31 and 33 and the air pipe 32.

With reference to FIGS. 9, 10, 11 and 12, the sole according to the present invention is first disposed within a shoe. When the user walks with the shoe, the heel will be lifted first. In the meantime, the first air bag 31 is not subjected to pressure, fresh air will enter into the first air bag 31 via the inlet 311 and the air in the chamber 13 will be continuously ejected to the foot through the arrow-shaped recesses 11 and the diamond-shaped recesses 12. Further, the arrow-shaped recesses 11 and the diamond-shaped recesses 12 are deformed thereby preventing the shoe from slipping (see FIG. 9). Then, when the sole is lifted subsequently, the first air bag 31, the arrow-shaped recesses 11 and the chambers 13 formed by the diamond-shaped recesses 12 of the resilient pad 10 are filled with air (see FIG. 10). As the heel is in contact with the ground, the first air bag 31 will be squeezed thereby ejecting fresh air therein out of the outlets 331 of the second air bag 33 via the air pipe 32 (see FIG. 11). When both the heel and the sole are in contact with the ground simultaneously, the first air bag 31 will be continuously squeezed to supply air to the foot and the chamber 13 will be deformed to supply air to the foot.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A sole comprising:

a resilient pad provided with a plurality of arrow-shaped recesses and diamond-shaped recesses on a bottom and an elongated slot on a top, said arrow-shaped recesses and said diamond-shaped recesses being arranged alternately and extending obliquely and upwardly through said resilient pad to form a smaller open top thereby providing a chamber;

a blast device adapted to be received in the elongated slot of said resilient pad and having a first air bag at one end, a second air bag at the other, and an air pipe connecting said first air bag and said second air bag; and a piece of cloth covering top of said resilient pad.

* * * * *